United States Patent [19]

Seo et al.

[11] Patent Number: 4,899,655

[45] Date of Patent: Feb. 13, 1990

[54] DRIVING SYSTEM FOR A ROTARY PRESS

[75] Inventors: Akikazu Seo; Mitsunao Miyake, both of Mihara, Japan

[73] Assignee: Mitsubishi Jukogyo Kabushiki Kaisha, Tokyo, Japan

[21] Appl. No.: 278,174

[22] Filed: Dec. 1, 1988

[30] Foreign Application Priority Data

Dec. 1, 1987 [JP] Japan ..... 62-183484[U]

[51] Int. Cl.[4] ..... B41F 5/06; B41F 13/12

[52] U.S. Cl. ..... 101/181; 101/182; 101/248

[58] Field of Search ..... 101/174, 175, 176–180, 101/181–183, 184, 185, 136–140, 248, 216, 247

[56] References Cited

U.S. PATENT DOCUMENTS 3,221,651 12/1965 Tagliasacchi ..... 101/183

*Primary Examiner*—J. Reed Fisher

*Attorney, Agent, or Firm*—Wenderoth, Lind & Ponack

[57] ABSTRACT

A rotary press includes a plurality of printing units, a main shaft for driving all the printing units, a plurality of branch shafts branched from the main shaft, and drive units, each including a clutch and an individual drive motor disposed on the main shaft, for the respective printing units. Each printing unit is provided with an approach switch for detecting a particular position of a plate drum and a plate drum positioning device, in proximity to the particular position, for correcting the position of the plate drum to the particular position. Each drive unit is provided with an electromagnetic brake for stopping rotation of the plate drum in response to the approach switch and a main shaft positioning device on the respective sides of the clutch for correcting a phase deviation of a coupling section of the clutch.

6 Claims, 4 Drawing Sheets

DRIVING SYSTEM FOR A ROTARY PRESS

BACKGROUND OF THE INVENTION

1. Field of the Invention

The present invention relates to a driving system for a rotary press.

2. Description of the Prior Art

Description first will be made of a prior art driving system for a rotary press, art with reference to FIGS. 8 and 9. The known driving system for a rotary press is illustrated generally in FIG. 8, and a plate clamping device of a plate drum used in the known rotary press is shown in cross-section in FIG. 9. In FIG. 8, reference numerals 01, 02 and 03 respectively designate printing units of the known rotary press, and numeral 04 designates a folding machine thereof. In this rotary press, a main shaft 05 consists of main shaft sections connected in series along a straight line via a plurality of couplings 06 over the entire length of the rotary press so that it can be rotated synchronously. Also, for each of the printing units is formed a drive unit 010 which can rotate plate drums 09 and 09' in each printing unit in forward or reverse directions at a very slow speed (about 10 rpm) by means of an individual drive motor 08 by disconnecting a clutch 07. (In FIG. 8, the respective drive units 010 are enclosed by respective double-dot chain lines.) Reference numerals 011 designate branch shafts branched via bevel gear boxes 012, and numerals 013 designate electromagnetic brakes.

In FIG. 9, a plate clamping device 014 is provided for the purpose of stretching and securing a plate 015 onto the drum circumference of the plate drum 09. Clamping and dismounting of the plate 015 is effected by means of this device, and upon performing this operation it is necessary to stop the plate drum 09 at such location that manipulation of the plate clamping device 014 can be provided easily. To that end it is commonly effected that the drive unit 010 is isolated by disconnecting the clutch 07, the plate drum is made to rotate in a forward or reverse direction at a very slow speed of about 10 rpm by means of the individual drive motor 08, and when the plate clamping device 014 has come to a position where a mounting operation easily may be performed, the plate drums 09 and 09' are stopped by means of the electromagnetic brake 013 by manipulating a switch button. However, in many cases the plate drum will stop at a position considerably deviated from a desired stop position. Even if it is attempted to eliminate this disadvantage by stopping the plate drum by automatically actuating the electromagnetic brake by an approach sensor, the precision of the stop position will be on the order of ±10 mm relative to the circumferential surface of the plate drum due to fluctuations of load. This degree of precision is insufficient for use with recently developed automatic plate exchange systems.

Furthermore, since the clutches in the respective drive units are disconnected for exchanging the plates in the respective printing units, after completion of a plate mounting operation, phase matching of all of the respective printing units must be effected by connecting the respective clutches again at predetermined positions, and the deviation of the plate drum stop position in each printing unit is enlarged a deviation phase angle by approximately four fold at the main shaft due to the gear ratio involved. Therefore, methods employed in the prior art for attempting to avoid this problems include the following:

(1) Upon connecting a clutch, a mark on a wheel mounted on the main shaft is aligned with a mark on the opposite member by manually rotating the latter. Then the clutch is connected by means of a push-out device (by making use of an air cylinder or the like). Thereby, the clutch is connected at such position that a pin-shaped inter-unit phase-matching guide can enter into the opposite member.

(2) A clutch device having a wedge mechanism is used.

Though it is realized that the stop position of a plate drum must be achieved at a severe level of precision to make possible automation of the plate exchange operation, the above-described prior art system cannot satisfy this requirement, since the stop position will vary every time due to fluctuations of load, and the precision of stoppage is at a deviation of even ±10 mm on the circumference of the plate drum. In addition, since plate exchange is effected for each printing unit, it is carried out after a clutch in each drive unit has been disconnected. Thus, when the plate exchange operation has been finished, to enable synchronous operation again to be carried out, the clutches must be reconnected in a manner to bring the respective printing units into the same phase. However, in the above-described prior art system, the deviation of the stop position of each plate drum is enlarged at the main shaft, due to the gear ratio, to a deviation phase angle increased by about four fold. Hence, in a meshing type clutch which performs fixed position connection, coupling cannot be done and coupling is effected after phase matching has been carried out separately. Therefore, additional time and labor are necessitated. Furthermore, even if a correcting device having a wedge mechanism is employed for phase matching of the clutch, frictional resistance is large at the slide portion of the wedge, and thus, a large-sized device becomes necessary.

SUMMARY OF THE INVENTION

It is therefore one object of the present invention to provide an improved driving system for a rotary press that is free from the above-described disadvantages of the prior art driving system.

A more specific object of the present invention is to provide a driving system for a rotary press, in which when a plate is to be exchanged on a plate drum, the plate drum can be easily brought to a predetermined stop position for facilitating automation of the plate exchange operation.

Another specific object of the present invention is to provide a driving system for a rotary press, in which a main shaft positioning device can be of small size, saving of time and labor for exchanging a plate is realized, and hence operating efficiency of the rotary press can be enhanced.

According to one feature of the present invention, there is provided a driving system for a rotary press including a plurality of printing units, a main shaft for driving all the printing units, a plurality of branch shafts branched from the main shaft, and drive units each consisting of a clutch and an individual drive motor and disposed on the main shaft for the respective printing units. Each of the printing units is provided with an approach switch for detecting a particular position of a plate drum and a plate drum positioning device for correcting the position of the plate drum to such particular position in the proximity of the particular position of the plate drum. Each of the drive units is provided with an electromagnetic brake for stopping rotation of the plate drum in response to the approach switch and a main shaft positioning device on the respective sides of the clutch for correcting a phase deviation of a clutch coupling section.

According to another feature of the present invention, there is provided the above-featured driving system for a rotary press, in which there is further provided a fixed position coupling device for connecting the clutch at a particular position on the main shaft.

According to the present invention, when a plate is to be exchanged, in order to stop the plate drum, the clutch is disconnected and the plate drum is rotated at a very slow speed by means of the individual drive motor. Under such a condition, the stop position of the plate drum is detected with the aid of the approach switch and rotation of the plate drum is stopped by the electromagnetic brake. Subsequently, the stop position is corrected with high precision by means of the plate drum positioning device. In addition, a phase deviation at the clutch coupling section is corrected by means of the main shaft positioning device provided at the clutch section. As a result, the driving system for a rotary press according to the present invention is adapted for automation of plate exchange operations. Moreover, since the main shaft positioning device is required to correct only the deviation caused by backlash of the gears between the plate drum and the main shaft, the main shaft positioning device can be small-sized, the time necessitated for the plate exchange operation is lessened, and operating efficiency of a rotary press can be increased.

The above-mentioned and other objects, features and advantages of the present invention will become more apparent by reference to the following description of one preferred embodiment of the present invention, taken in conjunction with the accompanying drawings.

DESCRIPTION OF THE PREFERRED EMBODIMENT:

The present invention now will be described in greater detail with respect to the preferred embodiment illustrated in FIGS. 1 to 7.

Figure 1:
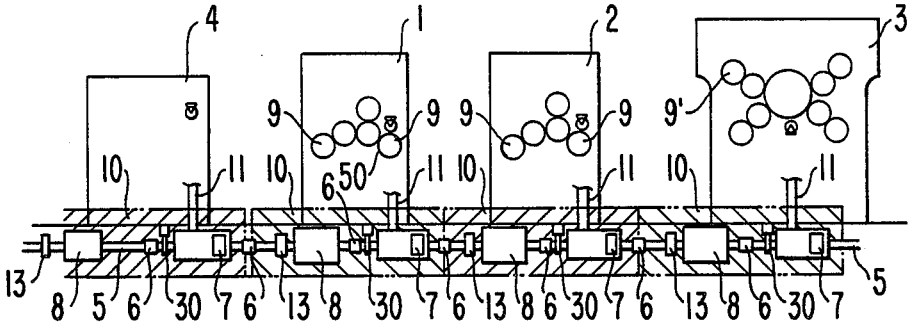
FIG. 1 is a schematic view of a driving system for a rotary press according to one preferred embodiment of the present invention.

In FIG. 1 is shown a main shaft 5 for driving a plurality of printing units 1, 2 and 3 and a folding machine 4. A plurality of branch shafts 11 branch from the main shaft. Clutches 7 which are provided on main shaft 5 for the respective printing units and enable disconnection and fixed position coupling. Individual drive motors 8 jointly form drive units 10 corresponding to the respective printing units. Furthermore, the main shaft 5 has a construction consisting of synchronously rotatable main shaft sections connected in series along a straight line via a plurality of shaft couplings 6 over the entire length of the rotary press.

Figure 2:
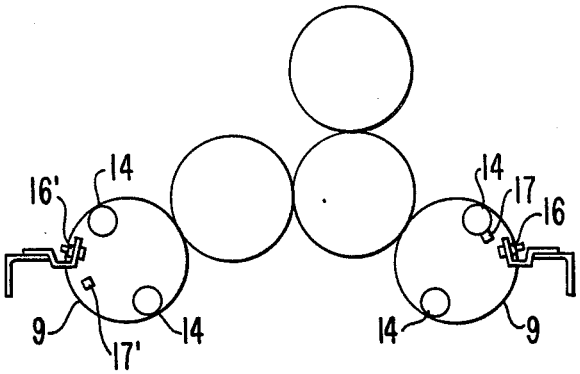
FIG. 2 is an enlarged partial view of the structure in FIG. 1.
Figure 3:
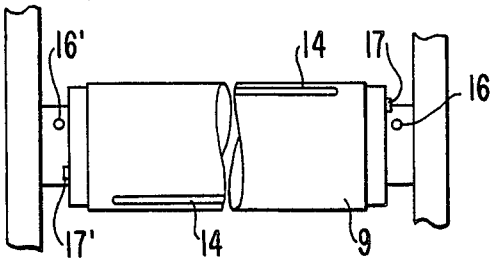
FIG. 3 is a side view of a plate drum in FIG. 2.

With reference to FIGS. 2 and 3, in each printing unit, approach switches 16, 16' for detecting particular positions of respective plate drums 9 and 9' are mounted to a machine frame to detect the positions of detection members 17 mounted on side or end surfaces of the respective plate drums 9 and 9'. Each detection member 17 is mounted at such position on the respective plate drum that it can cooperate with the approach switch 16 to stop the plate drum 9 at a position where a respective plate clamping device 14 can be easily manipulated. In addition, electromagnetic brakes 13 for stopping rotation of the main shaft 5 in response to detection signals issued from the respective approach switches 16 are provided in the respective drive units 10. It is to be noted that approach switches 16' and detection members 17' provided on the other side or end surfaces of the plate drums 9 and 9' are for use upon reverse rotation.

Each plate drum 9 is provided with a plate drum positioning device 18 for performing phase matching between the respective units upon a clutch coupling operation. The operation of device 18 is effected after the plate drum 9 has stopped in the proximity of the particular stop position in response to operation of the approach switch 16 and the electromagnetic brake 13 has been released.

Figure 4:
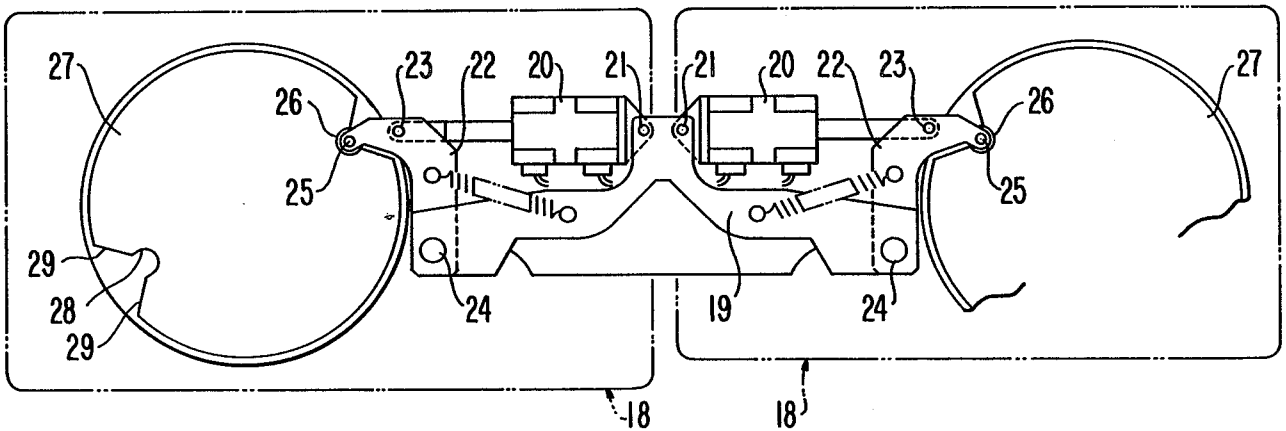
FIG. 4 is a front view showing a plate drum positioning device.
Figure 5:
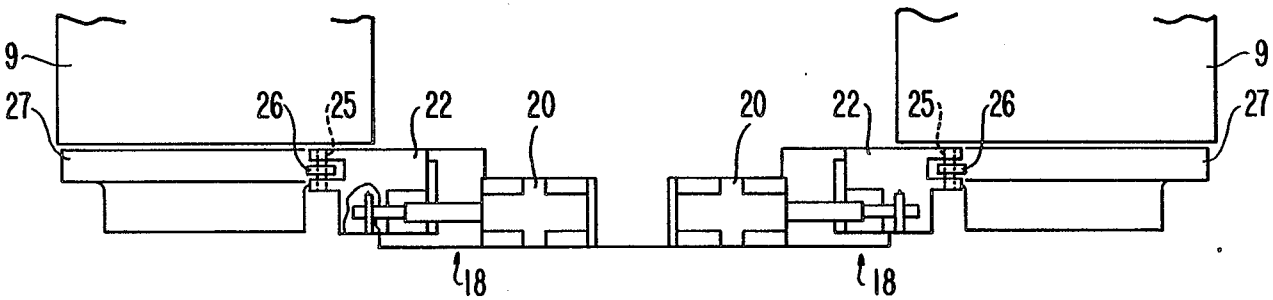
FIG. 5 is a plan view of the device shown in FIG. 4.

In the plate drum positioning device 18, as shown in FIGS. 4 and 5, a terminal end of an air cylinder 20 is coupled via a pin 21 to a member 19 supported from a frame of the machine, and the other end of the air cylinder is formed as a retractable rod and coupled via a pin 23 to the top end of an arm 22. The arm 22 is swingable and pivotably supported from the member 19 via a shaft 24, the outer end of the arm 22 is bifurcated, and a roller 26 is rotatably supported via a pin 25 by the bifurcated end portion. The roller 26 is so machined that it can fit with high precision in a groove or recess 28 formed in a member 27 fixedly secured to the side end of the plate drum 9. In the proximity of groove 28 are provided inclined guide surface portions 29 for the roller 26 to be used for correcting deviation of the plate drum stop position.

Figure 6:
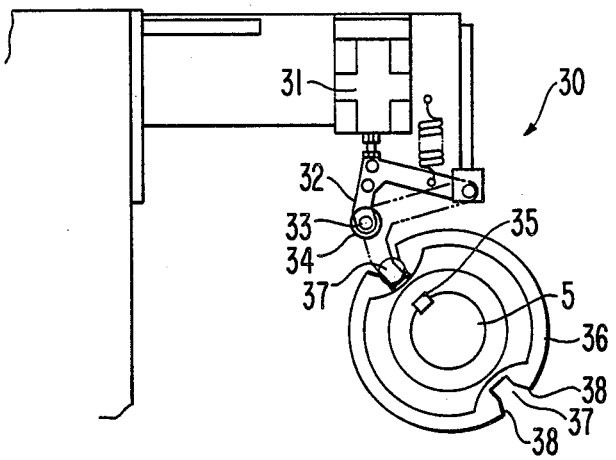
FIG. 6 is a front view showing a main shaft positioning device.

Furthermore, on the opposite sides of each clutch 7 in the driving system are provided main shaft positioning devices 30 which correct any phase deviation at the clutch coupling section caused by backlash of the gears between the plate drum 9 and the clutch 7 after operation of the plate drum positioning device 18. Thereby, coupling at a fixed position of the clutch 7 can be effected. Th main shaft positioning device 30 transmits the motion of a retractable bottom end rod of an air cylinder 31 as a swinging motion of an outside bifurcated end portion of an arm 32 as shown in FIG. 6, and the bifurcated end portion has a roller 34 rotatably secured thereto via a pin 33. The roller 34 is so machined that it can fit with high precision in a groove or recess 37 of a member 36 which is fixedly secured to the main shaft 5 via a key 35, and this groove 37 is provided with inclined guide surface portions 38 for the roller 34.

Figure 7:
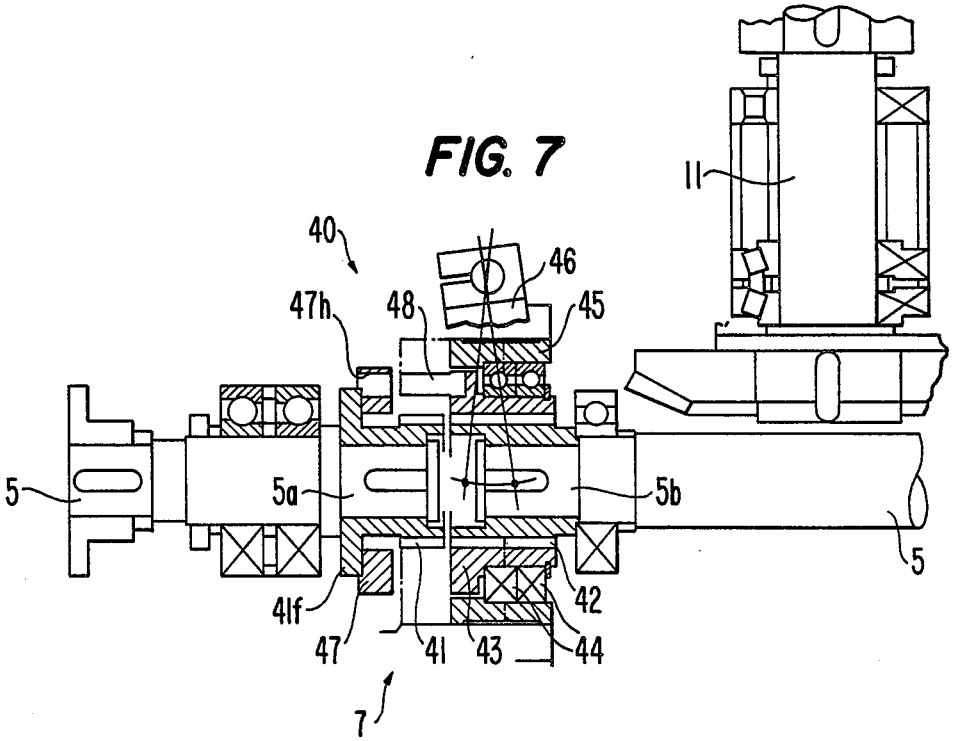
FIG. 7 is a cross-sectional view showing a clutch.
Figure 8:
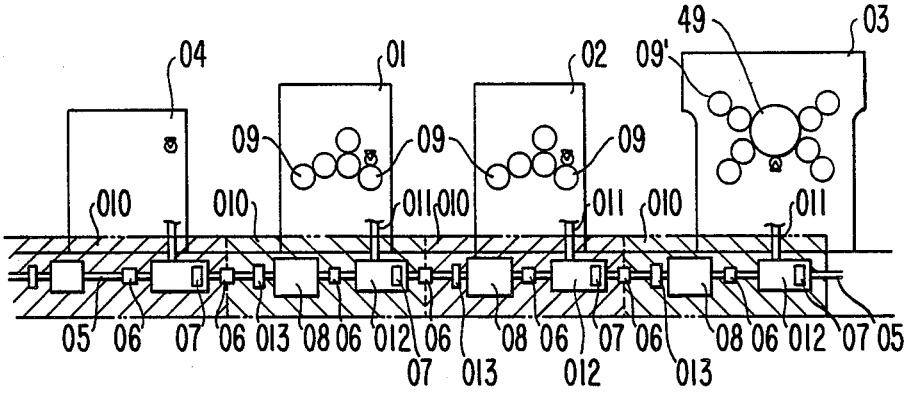
FIG. 8 (PRIOR ART)
FIG. 8 is a schematic view of a prior art driving system for a rotary press.
Figure 9:
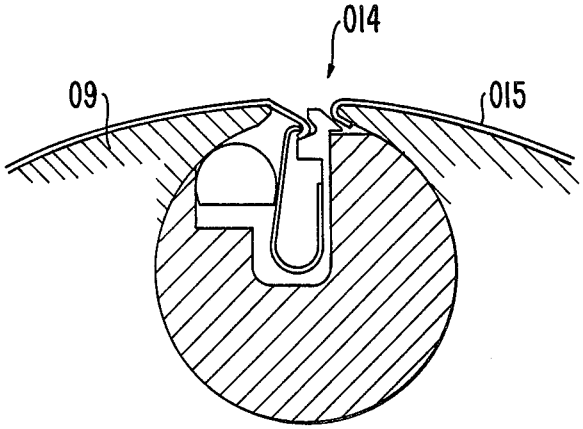
FIG. 9 (PRIOR ART)
FIG. 9 is an enlarged partial cross-sectional view showing a mode of mounting a plate onto a plate drum.

As shown in FIG. 7, a fixed position coupling device 40 for the clutch 7 is composed of an external gear 41 fixedly secured to a shaft end 5*a*, an external gear 42 fixedly secured to a shaft end 5*b*, a slidable internal gear 43 capable of simultaneously meshing with the gear 41 and the gear 42, a slide ring 45 fitted around the gear 43 via rolling bearings 44, a swing arm 46, a guide ring plate 47 fixedly secured to a flange portion 41*f* of the external gear 41 and having a guide hole 47*h*, and a guide pin 48 studded to the slidable internal gear 43. When the guide hole 47*h* and the guide pin 48 fit to each other with high precision and the external gears 41 and 42 are simultaneously meshed with the internal gear 43, or when meshing is released, the function as a clutch is realized. Owing to the provision of the guide hole 47*h* and the guide pin 48, the clutch 7 is capable of achieving coupling at the fixed position.

Description now will be made on the operation of the driving system for a rotary press according to the preferred embodiment of the present invention and having the above-described construction. In order to stop the plate drum so that the plate clamping device 14 on the plate drum 9 may stop at a particular stop position, the position of the detection member 17 mounted to the side surface of the plate drum 9 is detected by means of the fixed approach switch 16, and in response to a detection signal issued from the approach switch 16 the electromagnetic brake 13 for the main shaft 5 is actuated to stop and fix the position of the plate drum. Subsequently, since this stop position fluctuates over a considerably large range due to variation of the loading condition, at first the electromagnetic brake is released, and positioning of the plate drum is effected by actuating the plate drum positioning device 18. Thereby the main shaft 5 can be corrected in phase from the drive gears of the plate drum and the like via the branch shaft 11, and hence any phase deviation at the area of the clutch 7 is reduced to the order of the total amount (about 2–3 mm) of the backlash of the connected gear train. Furthermore, this deviation of phase of this main shaft is corrected by the main shaft positioning device 30. As a result of this correction, a precision in position on the order of ±0.1 mm can be attained at the position of meshing clutch gears. Under this condition, fixed position coupling of the clutch becomes possible, and connection of the is effected.

The above-described respective operating processes can be achieved through electric remote control or through continuous automatic control. Hence, it is possible to promote rationalization of operation by eliminating waste caused by manual operations, which was a problem to be resolved in the prior art, and the driving system can be adapted for automation of plate exchange by making use of a robot.

As described in detail above, according to the present invention, since a stop position of a plate drum can be corrected to a predetermined position by means of the plate drum positioning device after the plate drum has been stopped in the proximity of the predetermined position, the driving system for a rotary press can be adapted for automation of a plate exchange operation. In addition, since the main shaft positioning device is required to correct only the deviation caused by backlash of the gears between the plate drum and the main shaft, the main shaft positioning device can be small-sized. Also, shortening of the time necessary for the plate exchange operation becomes possible, and operating efficiency of the rotary press can be increased.

While the principle of the present invention has been described above in connection with one preferred embodiment of the invention, it is a matter of course that many apparently widely different embodiments of the present invention could be made without departing from the spirit of the present invention.

What is claimed is:

1. In driving system for a rotary press including a plurality of printing units each having plate drums with exchangeable plates, said driving system including a main shaft and a plurality of branch shafts for operatively connecting said main shaft to respective of the printing units, thereby to drive the printing units in synchronism during a printing operation, said main shaft including a plurality of axially connected shaft sections for respective of the driving units, whereby it is necessary periodically to disconnect drive of respective of the printing units by said main shaft and to stop selected of the plate drums to enable exchanges of plates thereof, each printing unit having respective clutch means for disconnecting drive of said main shaft to the respective said shaft section and thereby to the respective said branch shaft, and each printing unit having a respective individual drive motor for driving said respective branch shaft upon disconnection of drive of said main shaft thereto by said respective clutch means, the improvement comprising means for, upon said disconnection by each said clutch means, ensuring that at least a selected plate drum of the respective driving unit is stopped at a predetermined position thereof to enable exchange of the plate thereof, and for, upon completion of such plate exchange operation, ensuring that the disconnected respective said shaft section is aligned with said main shaft to enable said clutch means to reconnect said respective shaft section to said main shaft, said ensuring means comprising:

approach switch means for detecting said predetermined position of the selected plate drum;

electromagnetic brake means operable in response to said approach switch means to stop the selected plate drum at an initial stopped position approximately at said predetermined position thereof;

plate drum positioning means, located adjacent said predetermined position, for, after stopping of the plate drum by said brake means, moving the plate drum from said initial stopped position to said predetermined position;

whereby exchange of the plate is possible; and main shaft positioning means for moving said disconnected respective shaft section to a position aligned with axially adjacent shaft sections of said main shaft, whereby said clutch means then can be reconnected.

2. The improvement claimed in claim 1, wherein said clutch means includes external gears on said respective shaft section and on an adjacent shaft section of said main shaft, an axially slidable internal gear, and means for axially sliding said internal gear between a coupled position meshing with both said external gears and a disconnected position out of meshing engagement with at least one of said external gears.

3. The improvement claimed in claim 2, wherein said one external gear has therein a guide hole, and said internal gear has extending axially therefrom a guide pin that fits into said guide hole when said internal gear is in said coupled position.

4. The improvement claimed in claim 1, wherein said approach switch means is to be located at a fixed position of the respective printing unit and is responsive to a detection member to be mounted on the respective plate drum.

5. The improvement claimed in claim 1, wherein said plate drum positioning means comprises a member to be fixed to an end of the plate drum for rotation therewith, said member having in the periphery thereof a recess, a lever mechanism having a roller to fit with high precision in said recess, and means for moving said lever mechanism and thereby said member to a location whereat the plate drum is in said predetermined position.

6. The improvement claimed in claim 1, wherein said main shaft positioning means comprises a member fixed to said respective shaft section and having a recess, a lever mechanism arrangement having a roller to fit with high precision in said recess, and means for moving said lever arrangement and thereby said member to said position whereat said clutch means can be reconnected.

* * * * *